US006642644B2

(12) United States Patent
Kim et al.

(10) Patent No.: US 6,642,644 B2
(45) Date of Patent: Nov. 4, 2003

(54) SHADOW MASK FOR COLOR CRT HAVING VERTICAL SLOTS

(75) Inventors: Sung Yeon Kim, Gumi (KR); Hyeon Soo Hong, Gumi (KR)

(73) Assignee: LG Electronics Inc., Seoul (KR)

( * ) Notice: Subject to any disclaimer, the term of this patent is extended or adjusted under 35 U.S.C. 154(b) by 22 days.

(21) Appl. No.: 09/964,372

(22) Filed: Sep. 28, 2001

(65) Prior Publication Data

US 2002/0153821 A1 Oct. 24, 2002

(30) Foreign Application Priority Data

Apr. 20, 2001 (KR) ..... 2001-21289

(51) Int. Cl.[7] ..... H01J 29/80
(52) U.S. Cl. ..... 313/402; 313/403
(58) Field of Search ..... 313/402, 403, 313/407, 408

(56) References Cited

U.S. PATENT DOCUMENTS 4,210,842 A * 7/1980 Nakayama et al. ..... 313/403
4,638,212 A * 1/1987 Nakamura ..... 313/479
5,616,985 A * 4/1997 Hosotani ..... 313/403
5,877,586 A * 3/1999 Aibara ..... 313/402
6,064,147 A * 5/2000 Hosotani ..... 313/463
6,455,991 B2 * 9/2002 Tsuji ..... 313/402
6,486,596 B1 * 11/2002 Inoue et al. ..... 313/402

* cited by examiner

*Primary Examiner*—Vip Patel
*Assistant Examiner*—Kevin Quarterman
(74) *Attorney, Agent, or Firm*—Birch, Stewart, Kolasch & Birch, LLP

(57) ABSTRACT

Disclosed is for improving a shadow mask having a open type slot combining a plurality of slots of shadow mask in order to improve the brightness of a color CRT (Cathode Ray Tube). A plurality of slots are formed so that electron beams are passed through the slots in vertical direction, and a vertical pitch distance $Pv_C$ between slots located around horizontal center line is longer than a vertical pitch distance $Pv_E$ between slots located around horizontal edge. Therefore, a distortion and an inferiority which are may be generated in fabricating the shadow mask can be prevented, and the shadow mask is able to cope with vibration pressed on the shadow mask by improving strength of boundary part.

17 Claims, 5 Drawing Sheets

SHADOW MASK FOR COLOR CRT HAVING VERTICAL SLOTS

BACKGROUND OF THE INVENTION

1. Field of the Invention

The present invention relates to a shadow mask for a color CRT (Cathode Ray Tube), and particularly, to a shadow mask for a color CRT having a open type slot combining a plurality of slots in a shadow mask in order to improve the brightness of the color CRT 2. Description of the Background Art A typical conventional color CRT is constructed as follows.

A glass envelope of the CRT is composed of a front glass panel 1 which is attached at a rear portion thereof to a glass funnel 2. Behind a screen portion of the panel 1, there is positioned a shadow mask 3 which serves as a selection filter for a fluorescent screen 4 formed on an inner surface of the panel 1. A deflection yoke 5 mounted on a neck portion of the funnel 2 causes electron beams 6 to be scanned across the screen 4 through openings formed in the shadow mask 3 to cause the screen 4 to fluoresce and emit light through the panel 1 to display an image. Typically, the openings in the shadow mask 3 are in the form of slots.

The shadow mask 3 is supported by a frame 7 which is coupled to the panel 1 by a spring 8. An inner shield 9 is also mounted to the frame, for blocking external magnetic fields. An electron gun assembly 10 is attached at the neck end of the funnel 2 for generating the electron beams 6. The envelope of the CRT is evacuated, that is, under an internal vacuum. A reinforcing band 11 is installed around a skirt of the panel 1.

The color CRT described above is operated as follows. The electron beams 6 from the electron gun mounted in the neck of the CRT impinge upon the fluorescent screen 4 formed inside the panel 1, when an anode voltage is applied. At that time, the electron beams are deflected upward/downward and left/right by a deflection yoke 5 before arriving at the fluorescent screen.

In addition, there are bipolar, tetrapolar, and hexapolar magnets 10 for correcting the paths of the electron beams 6 so that the electron beams 6 are able to impinge upon the fluorescent material precisely, whereby the deterioration of color purity in the displayed image is prevented.

Moreover, the CRT is under a high vacuum, and therefore it may be easily cracked or damaged by an external shock. In order to prevent the cracking or damage, the panel 1 is designed to have a structural strength for with standing the external atmospheric pressure.

Also, because of the reinforcing band 11 installed on a skirt of the panel 1, the stress on the CRT in the high vacuum state is dispersed.

In the color CRT adapting a tension type shadow mask, in order to improve the brightness, which is one of the most important qualities, the transmissibility of the electron beam passing through the shadow mask should be improved. In addition, in order to improve the transmissibility, the area of the openings through which the electron beam passes should be increased. In a slotted shadow mask, in order to enlarge the opening area, the width of the slot openings may be increased or the length of the slot openings may be lengthened.

If the area of the slots is enlarged, the size of the electron beams admitted therethrough are enlarged in the horizontal direction of the shadow mask when the scanned electron beams impinge upon the fluorescent material formed on the screen after passing through the slot. Therefore, allowance for landing error, which is generated when the electron beams do not impinge upon the fluorescent material precisely because the path of the electron beams is changed by external influence or by the characteristics of the color CRT, is reduced. So, when the width of the slot openings is maintained and the length of the slot openings is increased in consideration of the allowance for landing error, the electron beam transmissibility is controlled by increasing the length of the slot openings with regard to bridge shadows, which are generated by the bridges arranged between slots with a certain dimension and are seen by a user, and to Moire, that is, an interference effect of light made by compounding the spacing of the bridges dividing the slots in the vertical direction and the scanning spacing of the deflection yoke.

Also, in order to improve thermal expansion characteristics of the shadow mask, in the conventional art, the vertical pitch distance between slots is formed at twice the length, or no bridge may be formed in a column, whereby the thermal expansion characteristics of the shadow mask can be improved.

However, in the conventional color CRT including a tension type shadow mask adapting the enlarged, or so-called open type bridges in order to improve the brightness and thermal expansion characteristics, and to cope with the Moire effect phenomena, the vertical pitch, that is, the distance between the slots is very much longer than the aperture vertical pitch of other shadow masks, and therefore there may be generated problems in manufacturing the shadow mask. That is, as shown in FIG. 2, the slots are oriented perpendicularly to a rolling direction, in order to improve a creep characteristics which is one of the most important features in choosing materials of the tension type shadow mask, because a dislocation is generated inside the metal of the shadow mask and on the surface of the metal when the metal is rolled, and the dislocation surface is formed in the rolling direction.

In the dislocation surface, the mechanical characteristics, that is, a tensile strength and a stain modulus of the dislocation surface are low perpendicular to the rolling direction, but the tensile strength and the strain modulus of the dislocation surface are relatively high parallel to the rolling direction because a slip is generated between the coupled structure of the material forming the dislocation surface.

Therefore, it is desirable that the slots are formed to extend in a direction perpendicular to the direction of the rolling when the shadow mask is manufactured.

However, when the color selection electrodes are manufactured perpendicular to the direction of the rolling, there may be some problems, that is, there may result a difference in physical properties between an effective area in which the slots are formed and a non-effective area in which slots are not formed, thereby causing an enlarging of the vertical pitch distances between the slots using the open type bridge. When the shadow mask is manufactured, a tensile force is given to the metal along the rolling direction for conveying the metal, and the slots are formed extending in a direction perpendicular to the rolling direction in order to improve the creep characteristics. However, because the area of the bridges is much less than in the conventional aperture shadow mask, the bridges bordering the effective area and the non-effective area which are different in their physical properties may be broken by the concentrated force when the shadow mask is conveyed.

In addition, as the area of the bridges is small, the strength of the front surface of the shadow mask is weakened, and therefore many flanged parts and folds may be generated in the front surface of the shadow mask.

SUMMARY OF THE INVENTION

Therefore, an object of the present invention is to provide a shadow mask for a color CRT (Cathode Ray Tube) adapting a tension type shadow mask which is able to improve the thermal expansion characteristics (doming), and is able to solve the problems of deformation of the shadow mask and of slot size inequality caused by the long vertical pitch distance between slots in the shadow mask adapting the open type bridges in order to improve the brightness characteristic of the CRT.

To achieve the object of the present invention, as embodied and broadly described herein, there is provided a shadow mask for a color CRT in which a plurality of slots are formed arranged in vertical columns so that electron beams are able to pass each slot in vertical direction, a vertical pitch distance $Pv_C$ between slots located around a horizontal center line of the shadow mask is greater than a distance $Pv_E$ between slots located on the farthest outer part.

Also, it is desirable that the vertical pitch distance Pv between the slots is gradually shortened, so that the relation equation $1/6 \leqq Pv_E/Pv_C \leqq 1/3$ is satisfied in respect of a vertical pitch distance $Pv_C$ between slots around the horizontal center line of the shadow mask and a vertical pitch distance $Pv_E$ between slots at horizontal edges of the shadow mask.

In addition, it is desirable that the relation $1/3 \leqq Pv_M/Pv_C \leqq 1$ is also satisfied with respect to a vertical pitch distance $Pv_M$ between slots located intermediate the horizontal center line of the shadow mask and the horizontal edges of the shadow mask.

It is also desirable that a bridge width $Bw_C$ between the slots located around the horizontal center line of the shadow mask is smaller than a bridge width $Bw_E$ between slots located at the horizontal edges of the shadow mask.

And the present invention is also characterized in that the bridge width $Bw_C$ between slots located on the center line of the shadow mask is smaller than the bridge width $Bw_E$ between slots located on the horizontal edge of the shadow mask.

It is desirable that the bridge width Bw is enlarged from the horizontal center line to the edges gradually, or that the relation $1 < Bw_E/Bw_C \leqq 2$ is satisfied with respect to the bridge width $Bw_C$ between the slots proximate the horizontal center line and the bridge width $Bw_E$ proximate the edges.

Also, it is desirable that the relation $1 < Bw_M/Bw_C \leqq 2$ is satisfied in respect of the bridge width $Bw_C$ proximate the horizontal center line and the bridge width $Bw_M$ between slots located intermediate the horizontal center line and the edges.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
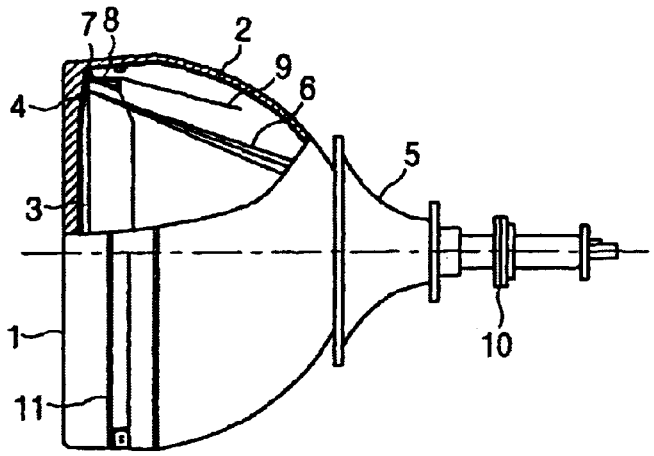
FIG.1 BACKGROUND ART
FIG. 1 is a cross-sectional view showing a general conventional color CRT.
Figure 2:
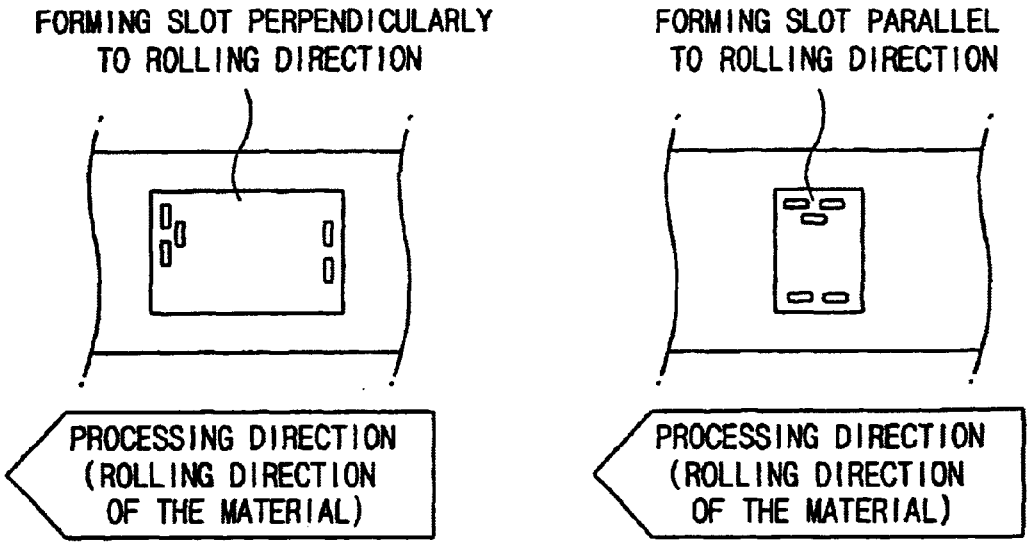
FIG. 2 is a schematic representation showing a rolling direction and slot direction when a shadow mask is fabricated.

Reference will now be made in detail to the preferred embodiments of the present invention, examples of which are illustrated in the accompanying drawings.

For convenience' sake, the same reference numerals are used for the same parts and members as those of the conventional art.

The color CRT to which the present invention is directed is one which adapts a tension type shadow mask, and accordingly the thickness of the shadow mask is reduced. Also, in order to improve the brightness of the CRT by increasing the transmissibility of the shadow mask, the width of the bridge portions is reduced and the length of the slot openings is increased.

In addition, a plurality of slots are combined as one slot in the shadow mask, and an open type bridge is adapted so that a plurality of electron beams can be passed to vertical direction of the slot, whereby the transmissibility is more increased.

Therefore, one of the important reasons for distortion of the shadow mask is due to lowering of the strength caused by reducing the width and number of the bridge portions. It is also a reason for breaking of the bridges due to stress concentration at the bridge portions located on the farthest edge, caused by the difference in physical properties between the effective area and the non-effective area. In order to prevent the lowering of the shadow mask strength as described above, the width of the bridge portions is increased. The extended width should be determined in consideration of the brightness being lowered due to reduced transmissibility of the electron beam according to the extension of the bridge width, and of the bridge shadow caused by the difference between the width of the open type bridge and that of a general bridge. In addition, a position on the shadow mask, which is pressed by maximum load when the shadow mask is fabricated, should be considered. When the strength of the shadow mask is increased by enlarging the width of the bridge in the above description, the benefits for using the open type bridge is reduced, if the width of the bridge is enlarged through the whole surface of the shadow mask and the transmissibility is lowered. And a part which is strong enough does not need to be strengthened.

Figure 3:
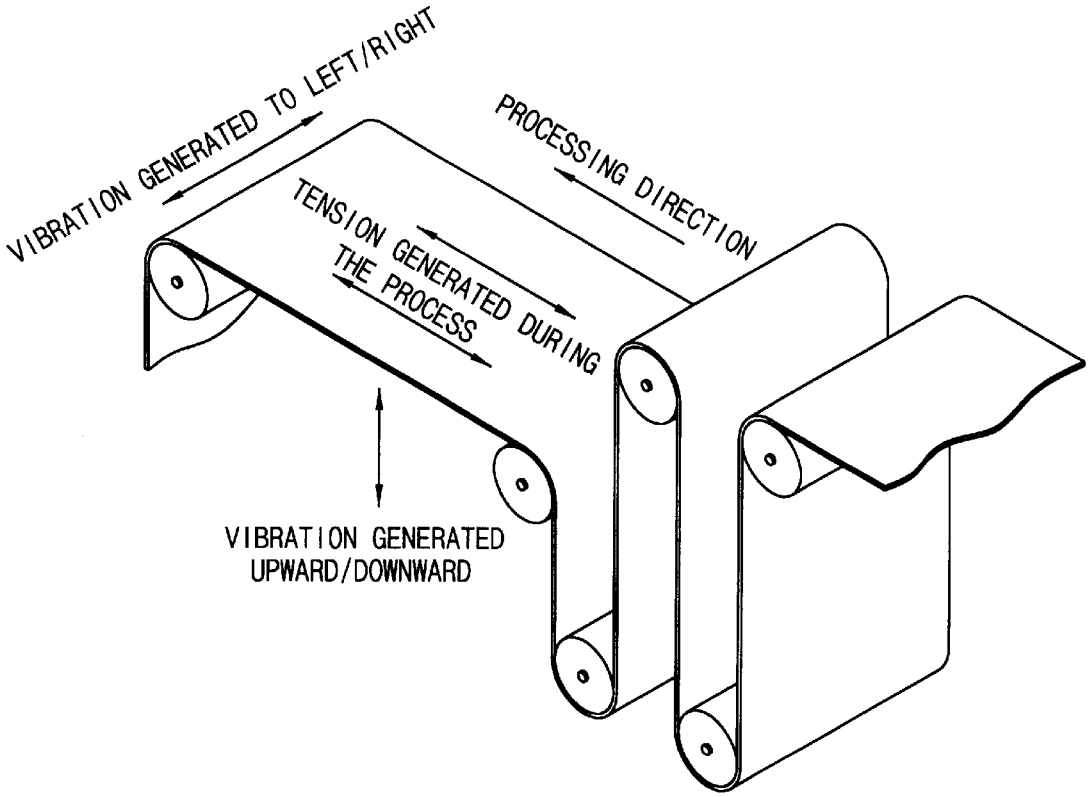
FIG. 3 is a perspective view showing tensions applied to the shadow mask when the shadow mask is fabricated.

The shadow mask is fabricated as etching the shape of the shadow mask on one single metal sheet. And the shadow mask is also cut by etching method without using a separate cutting machine. However, the cutting process is the final process in fabricating the shadow mask, and the raw metal sheet is rolled and conveyed in scrolled state, as shown in FIG. 3. According to the fabrication processing condition, the metal scroll on which the shadow mask shape is etched receives a certain tension so as to be conveyed. The metal sheet goes through a leveling process in order to remove residual stress of the shadow mask. In addition, the respective parts of the shadow mask are compressed and forced by the tension load continually. After the shadow mask goes through the process, the residual stress which is included in the shadow mask is removed but the strength of the positions on which the bridge is formed is weakened. In addition, the metal scroll is conveyed upward/downward with a little tremble and a slight displacement.

Strong tension load and compression load are applied to upper/lower part of the metal scroll during the conveying of the metal scroll. And the side parts of the metal scroll are weakened by the strong tension/compression loads.

Therefore when the etching process of the metal scroll is finished and electron beam apertures are formed on the shadow mask, the shadow mask is more likely to be distorted because the strength of the side part of the metal scroll is weakened.

If the distortion of the shadow mask is excessively large, the bridge may be cut.

In addition, the etching method for etching the shadow mask on the metal scroll can be made in two directions, that is, if the length direction of the slot is same as the processing direction of the metal scroll, the shadow mask is etched in the rolling direction, and if the slot is formed perpendicularly to the processing direction, the shadow mask is etched perpendicularly to the rolling direction.

The general shadow mask is fabricated perpendicularly to the rolling direction because of a creep, that is, the loaded shadow mask is permanently distorted when the shadow mask goes through a heat process.

If the shadow mask is fabricated perpendicularly to the rolling direction, the side parts (boundary part) of the shadow mask are more likely to be distorted by the loads on upper and lower parts of the shadow mask for conveying the shadow mask.

Therefore, according to the present invention, the bridge which is the weakest part is reinforced in order to prevent the distortion of the boundary parts.

Figure 7:
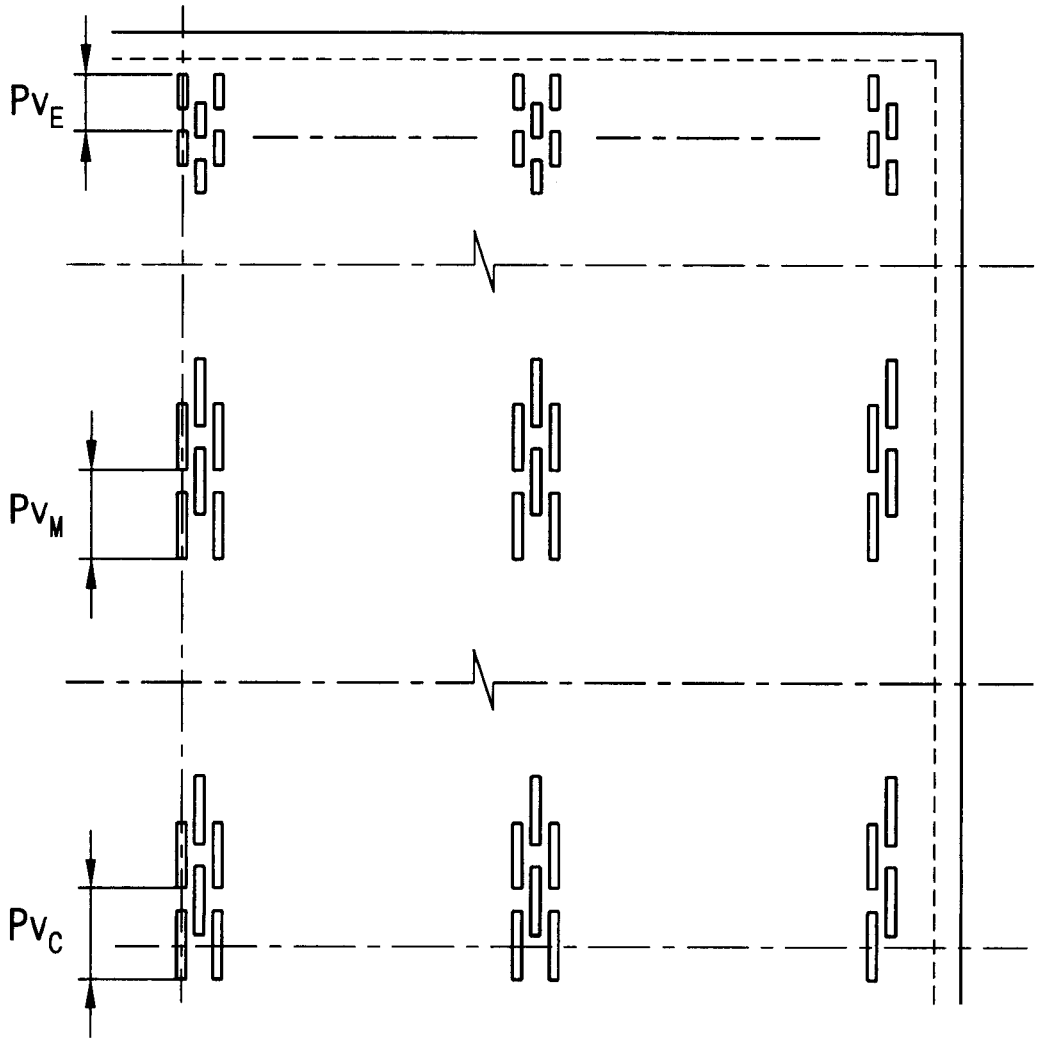
FIG. 7 is a detailed view showing the vertical pitch distances between slots applied in FIG. 5.

As shown in FIG. 7, the vertical pitch distances $Pv_C$, $Pv_E$, and $Pv_M$ between slots are reduced and reinforced in the shadow mask adapting the open type bridge. That is, the vertical pitch distance Pv between the slots located on the farthest edge from the center line of the shadow mask is reduced to be smaller than that between the slots located around the horizontal center line of the shadow mask, then the number of the vertical bridge between the slots located on the edge is more than that between the slots located around the horizontal center line.

Figure 8:
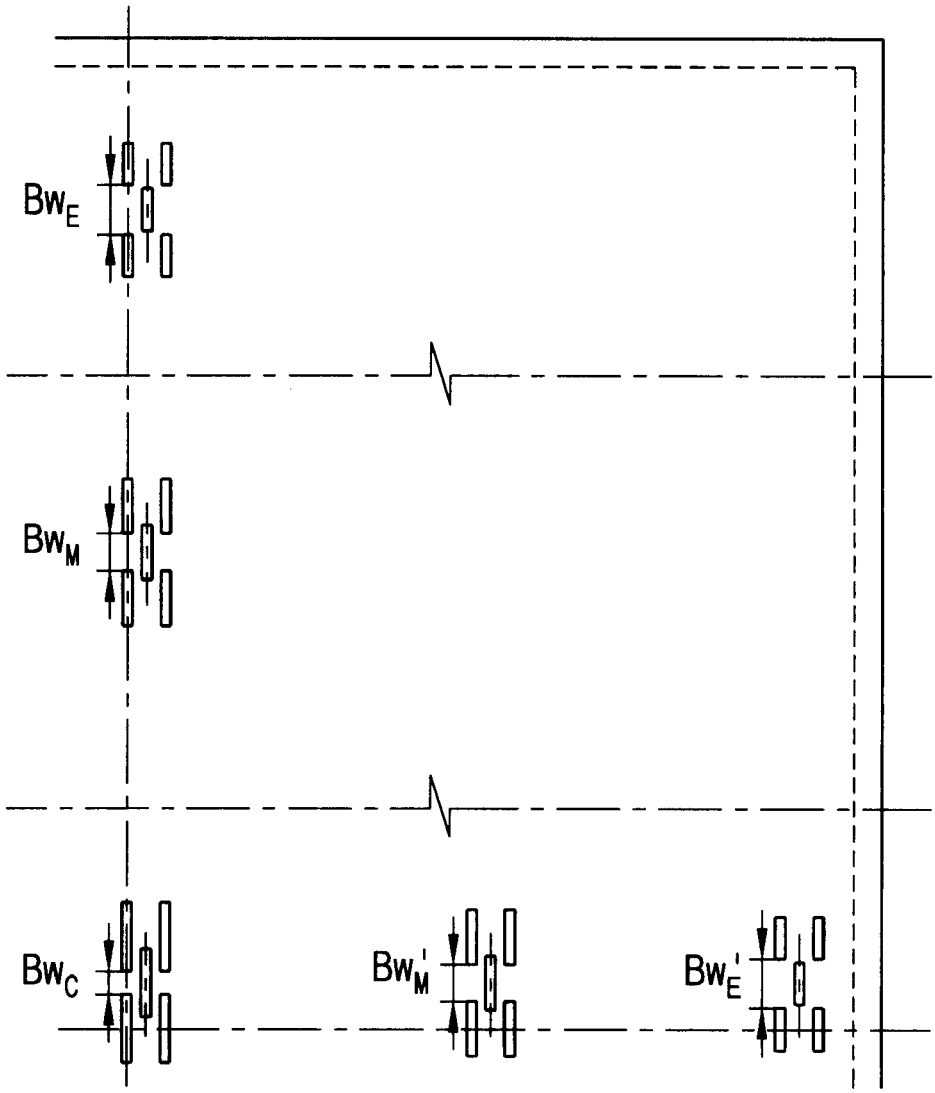
FIG. 8 is a detailed view showing the bridge widths between the slots applied in FIG. 6.

As shown in FIG. 8, the shadow mask can be reinforced by enlarging the bridge width $Bw_E$ between the slots located on the farthest edge from the horizontal center line larger than the bridge width $Bw_C$ between the slots located around the horizontal center line.

Also, the shadow mask can be reinforced by enlarging the bridge width $Bw_E'$ between the slots located on the farthest edge horizontally from the vertical center line of the shadow mask larger than the bridge width $Bw_C'$ between the slots located around the center of the shadow mask.

If the vertical pitch distance between slots located on boundary part is suddenly reduced, the physical properties are differentiated, whereby rumples may be generated on the reinforced part.

Figure 4:
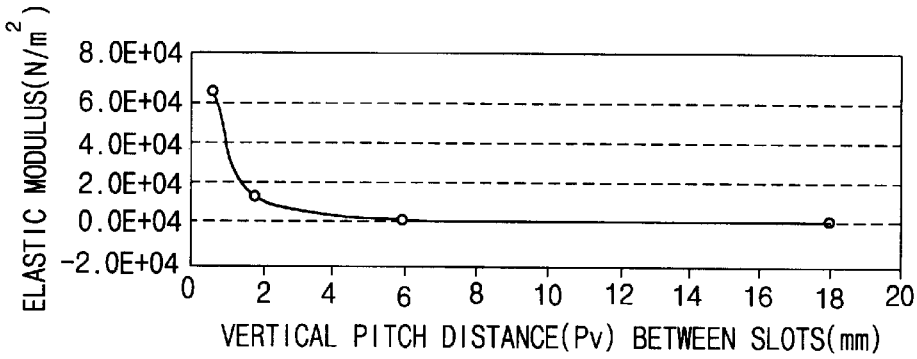
FIG. 4 is a graph showing the relation between the vertical pitch distance between slots and the elastic modulus of a shadow mask in the horizontal direction.

Therefore, the elastic modulus of the shadow mask for the vertical pitch distance between the slots located on the boundary part is shown in FIG. 4.

FIG. 4 is showing the elastic modulus is calculated only by changing the vertical pitch distance between the slots and maintaining a certain value of the bridge connecting the slots.

As shown in FIG. 4, the elastic modulus is rarely changed in a section in which the vertical pitch distances between the slots are 6 mm~18 mm, and the elastic modulus is changed rapidly in the section of the 0.5 mm~2 mm.

Therefore, when the vertical pitch distances between long slots around the horizontal center line are in the section of 6 mm~18 mm, if the elastic modulus is rapidly changed around the horizontal edge and the distortion may be generated. So, the vertical pitch distances should be changed step by step so that the elastic modulus is not rapidly changed. Therefore, the changing vertical pitch distances Pv should be within 1/9~1/3 of the vertical pitch distances $Pv_C$ between slots around the horizontal center line.

If the vertical pitch distance Pv is changed in the section smaller than 1/9 of the vertical pitch distances $Pv_C$ between slots around the horizontal center line, the greatest value is larger than that shown in the graph. And if they are changed in the section larger than 1/3 of the vertical pitch distances $Pv_C$ between slots around the horizontal center line, the difference of elastic modulus is small, whereby the strength of the bridge is not improved.

Figure 5:
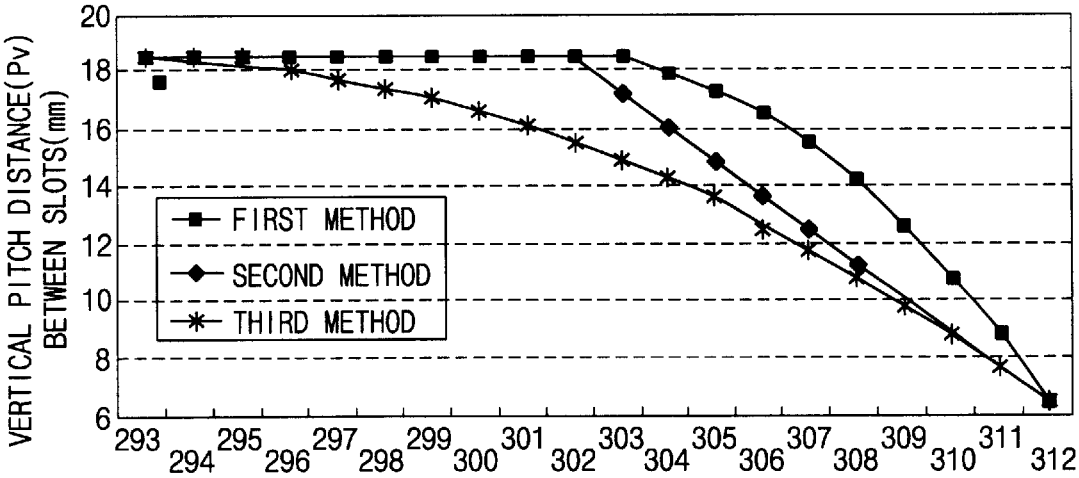
FIG. 5 is a graph showing the change in vertical pitch distances between slots of the shadow mask according to an embodiment of the present invention.

As shown in FIG. 5, methods for reducing the vertical pitch distances $Pv_E$ between the slots around the edge are divided into three methods, that is, reducing the distance describing a parabola after maintaining the distances to a certain part from the horizontal center line (first method), reducing the distances linearly after maintaining the distances same as that on the center line to a certain range (second method), and reducing the distances little by little from the center line.

When the shadow mask is fabricated as described above, the horizontal edge is reinforced, whereby a shadow mask of good quality can be obtained.

Figure 6:
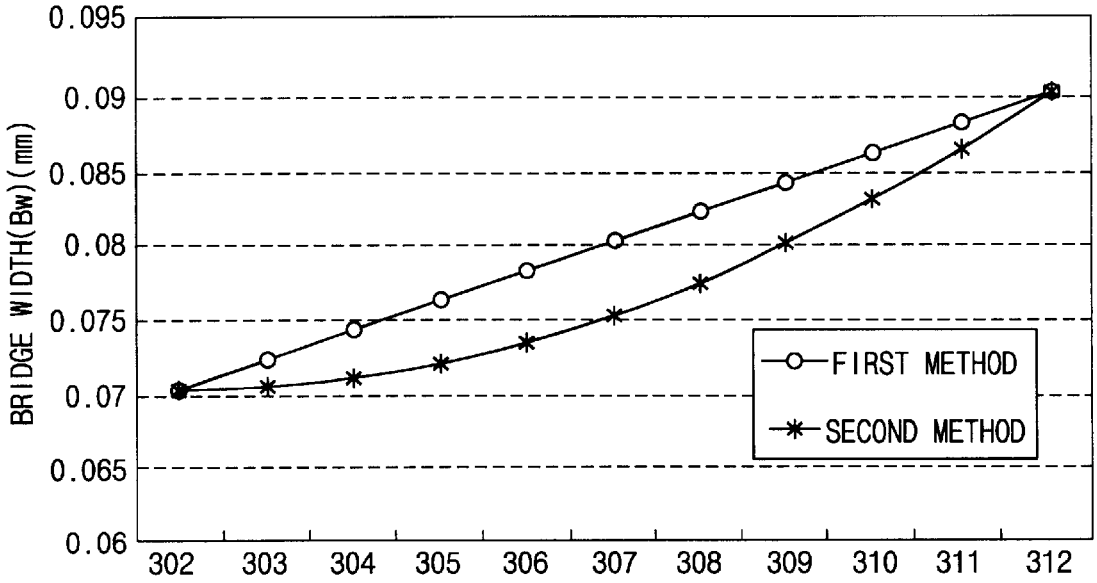
FIG. 6 is a graph showing the change in bridge widths between slots of the shadow mask according to another embodiment of the present invention.

As shown in FIG. 8, the strength can be directly improved by enlarging the bridge width. In addition, as shown in FIG. 6, the bridge width is enlarged by enlarging the widths gradually from the center line to the horizontal edge linearly (first method), or enlarging the widths while describing a parabola from the center line to the horizontal edge.

The enlarged bridge width should not be larger than twice of that on the center line.

Because, if the bridge width is larger than twice of that on the center line, the amount of electron beams is different with that of the center line prominently, accordingly, the brightness is differentiated greatly.

If the difference between brightness of horizontal center part and of the horizontal edge is large, the quality of the CRT may be deteriorated fatally.

As described above, the strength of the horizontal edge on the shadow mask can be improved by reducing the vertical pitch distances between slots, or by enlarging the bridge width.

According to the present invention, distortion and inferiority of the shadow mask which are may be generated in fabricating a shadow mask adapting an open type bridge in order to improve the brightness. Also, according to the present invention, the horizontal edge is strengthened, and therefore it can be cope with a vibration on the shadow mask.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A tension-type shadow mask for a color CRT (Cathode Ray Tube) having a panel formed with a fluorescent screen on an inner surface of the panel, a funnel connected with the panel, and an electron gun assembly attached at a neck portion of the funnel for generating electron beams, the shadow mask being installed near the fluorescent screen of the panel formed with a plurality of vertical slots for the passage of electron beams therethrough, wherein a vertical pitch distance Pv between upper ends of the adjacent slots in the same column located in a center of the shadow mask is greater than a vertical pitch distance $Pv_E$ between upper ends of the adjacent slots in the same column located in an edge from the center of the shadow mask.

2. The shadow mask according to claim 1, wherein a vertical pitch distance Pv is shortened gradually from the center to the edge of the shadow mask.

3. The shadow mask according to claim 1, wherein the relation $1/9 \leqq Pv_E/Pv_C \leqq 1/3$ is satisfied, wherein the $Pv_C$ is a vertical pitch distance in the center of the shadow mask, and the $Pv_E$ is a vertical pitch distance in the edge from the center of the shadow mask.

4. The shadow mask according to claim 3, wherein the relation $1/3 \leqq Pv_M/Pv_C \leqq 1$ is satisfied, where $Pv_M$ is a vertical pitch distance located intermediate of the center and the edge.

5. The shadow mask according to claim 1, wherein a bridge width $Bw_C$ between slots located in the center is less than a bridge width $Bw_E$ between slots located in the edge of the shadow mask.

6. The shadow mask according to claim 5, wherein the relation $1 < Bw_E/Bw_C \leqq 2$ is satisfied.

7. A tension-type shadow mask for a color CRT having a panel formed with a fluorescent screen on an inner surface of the panel, a funnel connected with the panel, and an electron gun assembly attached at a neck portion of the funnel for generating electron beams, the shadow mask being installed near the fluorescent screen of the panel formed with a plurality of vertical slots for passing electron beams therethrough, wherein a bridge width Bw between ends of adjacent slots in the same column formed in the shadow mask in a center of the shadow mask is less than a bridge width $Bw_E$ between ends of adjacent slots in the same column located in an edge of the shadow mask.

8. The shadow mask according to claim 7, wherein the bridge width Bw between slots increases gradually from the center to the edge of the shadow mask.

9. The shadow mask according to claim 7, wherein the relation $1 < Bw_E/Bw_C \leqq 2$ is satisfied, wherein the $Bw_C$ is a bridge width in the center of the shadow mask, and the $Bw_E$ is a bridge width in the edge from the center of the shadow mask.

10. The shadow mask according to claim 7, wherein the relation $1 < Bw_M/Bw_C \leqq 2$ is satisfied, where $Bw_M$ is a bridge width located intermediate of the center and the edge.

11. The shadow mask according to claim 7, wherein a bridge width $Bw_C'$ located in the center of the shadow mask is less than a bridge width $Bw_E'$ located in the edge of the shadow mask.

12. The shadow mask according to claim 1, wherein the edge is a horizontal edge of the shadow mask.

13. The shadow mask according to claim 1, wherein the edge is a vertical edge of the shadow mask.

14. The shadow mask according to claim 13, wherein the edge is a horizontal edge of the shadow mask.

15. The shadow mask according to claim 7, wherein the edge is a horizontal edge of the shadow mask.

16. The shadow mask according to claim 7, wherein the edge is a vertical edge of the shadow mask.

17. The shadow mask according to claim 16, wherein the edge is a horizontal edge of the shadow mask.

* * * * *